US005195643A

United States Patent [19]

Rocco

[11] Patent Number: 5,195,643

[45] Date of Patent: Mar. 23, 1993

[54] DELI BAG DISPENSER

[75] Inventor: Frank J. Rocco, Richmond, Va.

[73] Assignee: Reynolds Metals Company, Richmond, Va.

[21] Appl. No.: 811,868

[22] Filed: Dec. 23, 1991

[51] Int. Cl.[5] ..... A47F 7/00

[52] U.S. Cl. ..... 211/59.2; 211/49.1; 211/181; 312/42; 248/95

[58] Field of Search ..... 211/106, 59.2, 181, 211/49.1; 312/42, 45; 248/95, 97

[56] References Cited

U.S. PATENT DOCUMENTS

| | | | |
|---|---|---|---|
| 701,655 | 6/1902 | Widenhofer | 211/181 X |
| 959,839 | 5/1910 | Buehler | 211/181 X |
| 1,668,171 | 5/1928 | Pratt | 312/42 |
| 1,716,862 | 6/1929 | McEntire | 211/181 X |
| 2,682,956 | 7/1954 | Pike | 211/181 X |
| 2,944,679 | 7/1960 | Rubenstein | 211/181 |
| 3,094,217 | 6/1963 | Peterson | 211/106 X |
| 3,096,883 | 7/1963 | Llewellyn | 211/106 X |
| 3,144,960 | 8/1964 | Membrino | 211/63 X |
| 3,216,585 | 11/1965 | Whittle | 211/49.1 X |
| 4,117,936 | 10/1978 | Dawson | 211/181 X |
| 4,248,352 | 2/1981 | White | 211/106 X |
| 4,336,888 | 6/1982 | Fuller et al. | 211/181 X |
| 4,364,490 | 12/1982 | Long et al. | 220/407 |
| 4,385,733 | 5/1983 | O'Keefe | 211/181 X |
| 4,730,799 | 3/1988 | Foss et al. | 211/181 X |

*Primary Examiner*—Robert W. Gibson, Jr.
*Attorney, Agent, or Firm*—Alan T. McDonald

[57] ABSTRACT

A deli bag dispenser includes front, rear and bottom wire frames cradling a plurality of successively stacked bundles of plastic bags which are rolled unattached to each other. Support legs projecting rearwardly from the bottom frame enable the dispenser to be self supported on a flat surface with the stack being rearwardly and upwardly inclined for stable support. A pair of brackets secured to upper portions of the dispenser enable same to be wall mounted.

18 Claims, 1 Drawing Sheet

DELI BAG DISPENSER

TECHNICAL FIELD

The present invention relates generally to dispensers and, more particularly, dispensers for holding a plurality of rolls of plastic bags.

BACKGROUND ART

Sealable plastic bags, such as used in delicatessens, are packaged approximately 50 to a bundle, wherein the bags are successively rolled with their ends overlapping so that the outer most bags are individually peelable from the roll. Since these bags tend to be used in a retail store environment during times of peak demand for products stored in the bags, it is desirable to have a dispenser having various characteristics which enable storage and easy access to one or more bundles of the bags and which may be mounted to suit the operating conditions peculiar to the store.

It is accordingly one object of the present invention to provide a deli bag dispenser of wire frame construction which can hold and provide easy access to a plurality of bundles of deli bags.

Another object of the present invention is to provide a dispenser which may be either wall mounted or can sit on a countertop.

A still further object of the present invention is to provide a wire frame dispenser that provides good cradling support for one or more bundles of bags.

SUMMARY OF THE INVENTION

A wire frame dispenser for dispensing individual objects stored in rolls, in accordance with this invention, comprises a front frame, a rear frame, and a bottom frame, each made of wire and connected together to define a storage region adapted to contain a plurality of said rolls. The rolls rest on each other in stacked succession with their respective longitudinal axes extending parallel to each other and to the bottom frame. The front frame includes at least two front frame wire members extending upward from the bottom frame and spaced a sufficient distance from each other to enable a user's hand to reach in between the front wire members to engage and remove an object from any one of the stacked rolls.

The front and rear frames are preferably parallel to each other and extend to about the same height in mounted position. The front, rear and bottom frames are U-shaped in side elevational view while the front frame is preferably of inverted U-shape in front elevational view.

In the preferred embodiment, the front, rear and bottom frames are formed from a single wire.

The invention also features roll buckling prevention means, in the form of a wire secured to the rear frame, for preventing a bundle of bags from buckling rearwardly and being pushed back through the rear frame as the number of remaining bags in the bundle become few and the manual force exerted on the bundle when removing a bag therefrom tends to buckle the bundle. The roll buckling prevention means preferably includes a cross brace extending between a lower portion of the rear frame members at a predetermined distance above the bottom frame, and a second brace extending upward from the cross brace between the rear frame members.

The dispenser preferably includes support legs for supporting the front, rear and bottom frames on a horizontal surface. The support legs include at least a pair of coplanar legs extending in a plane forming an acute angle with a storage axis of the storage region, said axis extending generally parallel to and between the front and rear frames.

The invention also features brackets for mounting the dispenser to a vertical wall. The support legs preferably project rearwardly from the bottom frame a predetermined distance to contact the wall and thereby orient the storage axis upwardly inclined towards the wall to provide stable support for the bundles.

The dispenser comprises a further wire frame including a bottom wire cross frame extending along the bottom frame and having end portions respectively extending laterally outwardly from between the front and rear frames. Side braces respectively extend upwardly from opposite ends of the bottom wire cross frame to define the overall width of the dispenser. A top cross brace extends between, to interconnect, the upper ends of the side braces. The top cross brace is connected to the rear frame. This further wire frame is also preferably formed from a single wire different from the single wire forming the front, rear and bottom frames. Both single wires for the respective frame and braces jointly define a rigid construction where the frame and braces are immovable relative to each other.

A method of dispensing plastic bags from a plurality of bundles is also disclosed wherein the bags are rolled into the bundle unattached to each other for easy peeling form the bundle. The method comprises the steps of stacking a plurality of bundles in a storage region of a wire frame dispenser defined between front, rear and bottom wire frames and removing a bag from any one of the bundles by insertion of a user's hand through the front frame to engage and remove a bag from one of said rolls.

Still other objects and advantages of the present invention will become readily apparent to those skilled in this art from the following detailed description, wherein only the preferred embodiments of the invention are shown and described, simply by way of illustration of the best mode contemplated of carrying out the invention. As will be realized, the invention is capable of other and different embodiments, and its several details are capable of modifications in various obvious respects, all without departing from the invention. Accordingly, the drawing and description are to be regarded as illustrative in nature, and not as restrictive.

BEST MODE FOR CARRYING OUT THE INVENTION

Figure 2:
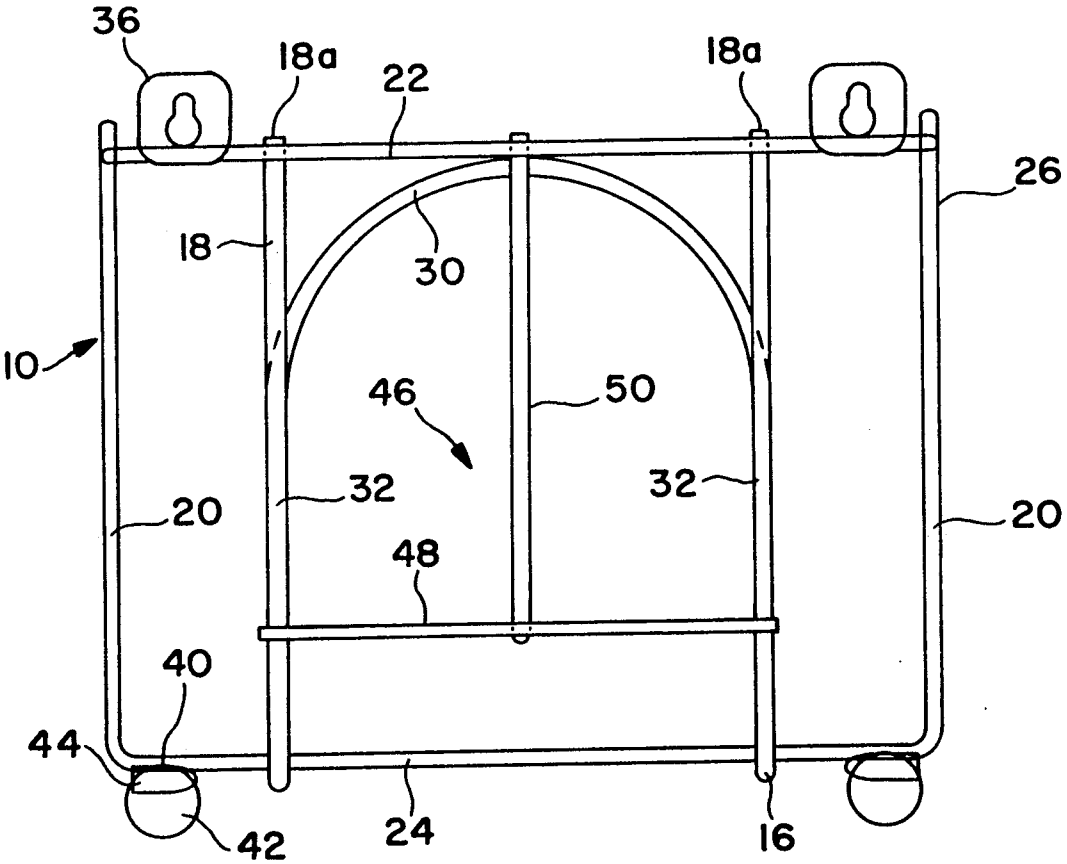
FIG. 2 is a front elevation view of the dispenser of FIG. 1.

Bag dispenser 10 of the present invention comprises, in the preferred embodiment, a front frame 12, a rear frame 14, and a bottom frame 16, preferably formed together (FIGS. 1 and 2) from a single wire rod 18 bent into a particular configuration as discussed more fully below. A pair of side braces 20 are respectively spaced outwardly from the front and rear frames 12, 14 define the lateral extent of the dispenser 10 and are interconnected at top and bottom portions thereof by horizontally extending top and bottom cross braces 22 and 24.

The top, bottom and side cross braces 22, 24, 20 may also be formed from a single wire 26 bent into a predetermined configuration. The front and rear frames 12, 14 support a plurality of bundles B of deli bags (FIG. 1 only) resting on top of each other. The bags (e.g., 50 in a full bundle B) are overlapped in staggered relationship within the roll and are not connected to each other, enabling an outermost bag B' in any one of the bundles to be easily grasped and peeled from the bundle by the user's hand extending through the front frame 12.

Front frame 12, in front elevational view (FIG. 2) has an inverted U-shape consisting of an inverted bight 30 defining the uppermost portion of the front frame and terminating in a pair of downwardly extending straight leg portions 32 spaced parallel to each other and to the side braces 20. With reference to the side elevational view of FIG. 1, these leg portions 32 curve rearwardly at 33 to define the bottom frame 16 and thence extend upwardly at 34 parallel to each other to define the rear frame 14.

Figure 1:
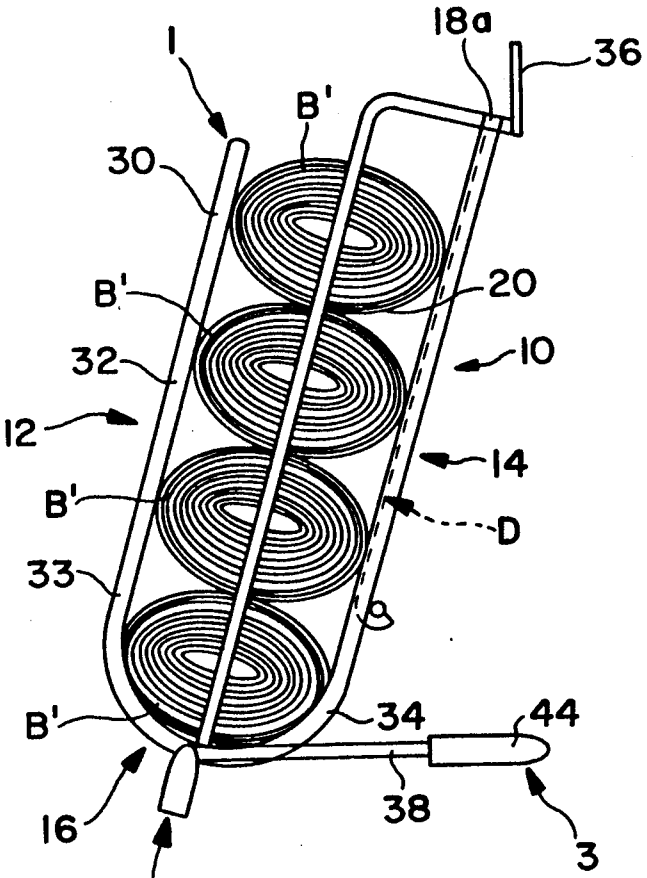
FIG. 1 depicts the wire frame dispenser of this invention in side elevational view.

The front and rear frames 12, 14 extend parallel to each other and, together with the bottom frame 16, are U-shaped in configuration (FIG. 1). The spacing between the front and rear frames 12, 14 generally corresponds to the diameter or major axis D of each full bundle B.

The uppermost ends 18*a* of the single wire 18 defining the rear frame 14 are welded to the single wire 26 defining the top cross brace 22. This single wire 26, at the opposite ends of the top cross brace 22, is bent through 90° to extend forwardly from the cross brace, perpendicular to the rear frame 14 for approximately one-half the depth between the front and rear frames 12, 14 and then curves downwardly through 90° to define the side braces 20 extending parallel to each other. At the lower end of each side brace 20, this wire 26 bends through 90° to curve inwardly and define the bottom cross brace 24.

The opposite ends of the single wire 26 may be welded together at any convenient point to form an endless structure defining the side braces 20, top cross brace 22 and bottom cross brace 24 in the manner described above. The bottom frame 16 may be welded to the bottom cross brace 24 to form rigid interconnections between wires 18 and 26.

A pair of mounting brackets 36 may be welded to opposite ends of the top cross brace 22 to facilitate wall mounting of the dispenser 10. Alternatively, the dispenser 10 may be self-supported on a flat horizontal surface (not shown) through the provision of a pair of rearwardly extending support legs 38 welded to opposite ends of the bottom cross brace 24 adjacent the side braces 20, respectively. The front end 40 of each support leg 38 may curve downwardly and thence into a U-shape of small radius so as to be covered with a pair of front resilient foot bumpers 42, respectively. The rearwardly projecting ends of each support leg 38 may also be covered with a resilient bumper 44.

The support legs 38 extend rearwardly from the side braces 20 at a predetermined angle A (shown to scale in FIG. 1) which is conducive to supporting a plurality of bundles B in the dispenser 10 by stably locating the center of gravity of the full dispenser between the front and rear support feet 42, 44. With reference to FIG. 1, it will be further appreciated that the rear support feet 44 terminate in the in substantially the same vertical plane as the mounting brackets 36 so as to rest against a vertical support wall (not shown) to orient the dispenser at the angle A when the dispenser is wall mounted.

The rear frame 14 of dispenser 10 further features an inverted T-shaped support 46 having a horizontally extending member 48 with opposite ends welded to the rear frame legs 32 and an upwardly extending member 50 having a lower end welded to the mid-point of the horizontal member 48 and an upper end welded to the mid-point of the top cross brace 22. This support structure 46 is co-planar with the rear frame 14 (as best depicted in FIG. 1) and advantageously serves to prevent a bundle B from buckling rearwardly and being pushed back through the rear frame 14 as the number of remaining bags in that bundle become few (e.g., 10) and the manual force exerted on the bundle when removing a bag B' therefrom tends to buckle the bundle and otherwise force the bags through the rear frame absent the anti-buckling structure 46.

Dispenser 10 thereby provides an effective means for holding a predetermined number of bundles B (e.g., 4) at one time by proving secure front, bottom and rear support in a wire structure enabling removal of a sealable plastic bag B' from any one of the stacked bundles B. Dispenser 10 may either be wall mounted using the two mounting holes formed in brackets 36 with feet 44 maintaining the stacking access of the bundles at predetermined angle A leaning towards the wall. In the alternative, the dispenser 10 may be rested on a countertop whereby feet 42, 44 prevent sliding of the leg and scratching and marking up counters and walls.

It will be readily seen by one of ordinary skill in the art that the present invention fulfills all of the objects set forth above. After reading the foregoing specification, one of ordinary skill will be able to effect various changes, substitutions of equivalents and various other aspects of the invention as broadly disclosed herein. It is therefore intended that the protection granted hereon be limited only by the definition contained in the appended claims and equivalents thereof.

I claim:

1. A wire frame dispenser for dispensing individual objects stored in rolls, comprising:

a front frame, a rear frame, and a bottom frame, each frame made of wire and connected together to define a storage region adopted to contain a plurality of said rolls, each roll resting on top of each other in stacked succession with their respective longitudinal axis extending parallel to each other and to the bottom frame, said front frame including at least two front frame wire members extending upward from the bottom frame and spaced a sufficient distance from each other to enable a user's hand to reach in between the front frame wire members to engage and remove an object from one of the rolls.

2. The dispenser of claim 1, wherein said front and rear frames are generally parallel to each other and extend to about the same height in mounted position.

3. A dispenser of claim 1, wherein said front, rear and bottom frames are U-shaped in side elevational view.

4. The dispenser of claim 1, wherein said front frame is inverted U-shaped in front elevational view.

5. The dispenser of claim 1, wherein said front, rear and bottom frames are formed from a single wire.

6. The dispenser of claim 1, further comprising roll buckling prevention means, in the form of a wire secured to the rear frame, for preventing a roll from buckling rearwardly and being pushed back through the rear frame as the number of remaining objects in the roll become few and the manual force exerted on the roll when removing an object therefrom tends to buckle the roll.

7. The dispenser of claim 6, wherein said roll buckling prevention means includes a cross brace extending between a lower portion of the rear frame members a predetermined distance above the bottom frame and a second brace extending upward from the cross brace between the rear members.

8. The dispenser of claim 1, further comprising support leg means for supporting the front, rear and bottom frames on a horizontal support surface, said support leg means including at least a pair of coplanar legs extending in a plane forming an acute angle with a storage axis extending generally parallel to and between the front and rear frames.

9. The dispenser of claim 8, further comprising bracket means for mounting the dispenser to a vertical wall.

10. The dispenser of claim 9, wherein said support legs project rearwardly from the bottom frame a predetermined distance to contact the wall, in the wall mounted position, and thereby orient the storage access upwardly inclined towards the wall at said angle A to the horizontal.

11. The dispenser of claim 1, further comprising a further wire frame including a bottom wire cross frame extending along the bottom frame and having end portions respectively extending laterally outwardly from between the front and rear frames, side braces respectively extending upwardly from opposite ends of the bottom wire cross frame to define the width of the dispenser, and a top cross brace extending between to interconnect the upper ends of the side braces, said top cross brace being connected to the rear frame.

12. The dispenser of claim 11, wherein said further wire frame is formed from a single wire.

13. The dispenser of claim 12, wherein said front, rear and bottom frames are formed from a single wire which is different from the single wire forming the further wire frame.

14. The dispenser of claim 13, wherein both said single wires form the respective frames and braces which jointly define a rigid construction and which are immovable relative to each other.

15. The dispenser of claim 1, further comprising support leg means for supporting the front, rear and bottom frames on a horizontal support surface, said support leg means including at least a pair of coplanar legs extending in a plane forming an acute angle with a storage axis extending generally parallel to and between the front and rear frames.

16. The dispenser of claim 1, further comprising a further wire frame including a bottom wire cross frame extending along the bottom frame and having end portions respectively extending laterally outwardly from between the front and rear frames, side braces respectively extending upwardly from opposite ends of the bottom wire cross frame to define the width of the dispenser, and a top cross brace extending between, to interconnect, the upper ends of the side braces, said top cross brace being connected to the rear frame.

17. The dispenser of claim 1, wherein said objects are plastic bags which are rolled unattached to each other to form the roll.

18. A method of dispensing a plurality of plastic bags which are rolled unattached to each other into a bundle, comprising the steps of:

stacking a plurality of said bundles by successively placing the same in a storage region of a dispenser having front, rear and bottom frames; and removing a bag from one of said bundles by insertion of the user's hand between front wire members defining the front frame to engage and remove the bag from said bundle.

* * * * *